US009347287B2

(12) United States Patent
Hughes et al.

(10) Patent No.: US 9,347,287 B2
(45) Date of Patent: May 24, 2016

(54) WELLBORE TREATMENT TOOL AND METHOD

(71) Applicant: Resource Well Completion Technologies Inc., Calgary (CA)

(72) Inventors: John Hughes, Calgary (CA); Ryan Dwaine Rasmussen, Calgary (CA); James Wilburn Schmidt, Calgary (CA)

(73) Assignee: RESOURCE COMPLETION SYSTEMS INC., Calgary (CA)

( * ) Notice: Subject to any disclaimer, the term of this patent is extended or adjusted under 35 U.S.C. 154(b) by 431 days.

(21) Appl. No.: 13/857,230

(22) Filed: Apr. 5, 2013

(65) Prior Publication Data

US 2014/0209306 A1 Jul. 31, 2014

Related U.S. Application Data

(60) Provisional application No. 61/758,655, filed on Jan. 30, 2013, provisional application No. 61/764,717, filed on Feb. 14, 2013.

(51) Int. Cl.
*E21B 23/02* (2006.01)
*E21B 23/00* (2006.01)

(52) U.S. Cl.
CPC ..... *E21B 23/02* (2013.01); *E21B 23/00* (2013.01)

(58) Field of Classification Search
CPC ... E21B 33/1294; E21B 33/00; E21B 33/128; E21B 23/00; E21B 23/02; E21B 23/04; E21B 23/06; E21B 23/08; E21B 23/14
See application file for complete search history.

(56) References Cited

U.S. PATENT DOCUMENTS 4,312,406 A 1/1982 McLaurin et al.
4,410,040 A * 10/1983 Longacre et al. ..... 166/118
6,024,173 A 2/2000 Patel et al.

(Continued)

FOREIGN PATENT DOCUMENTS

CA 2639341 3/2009
CA 2693676 7/2010

(Continued)

OTHER PUBLICATIONS

Wireline Tools and Equipment Catalog—Tools International Corporation, Jun. 1, 2008.
2002 Flow Control Systems Catalog—Baker Oil Tools, Copyright 2002.

*Primary Examiner* — Brad Harcourt
(74) *Attorney, Agent, or Firm* — McDonnell Boehnen Hulbert & Berghof LLP

(57) ABSTRACT

A wellbore treatment tool for setting against a constraining wall in which the wellbore treatment tool is positionable, the wellbore treatment tool including: a tool body including a first end formed for connection to a tubular string and an opposite end; a no-go key assembly including a tubular housing and a no-go key, the tubular housing defining an inner bore extending along the length of the tubular housing and an outer facing surface carrying the no-go key, the no-go key configured for locking the no-go key and tubular housing in a fixed position relative to the constraining wall, the tubular housing sleeved over the tool body with the tool body installed in the inner bore of the tubular housing; and a sealing element encircling the tool body and positioned between a first compression ring on the tool body and a second compression ring on the tubular housing, the sealing element being expandable to form an annular seal about the tool body by compression between the first compression ring and the second compression ring.

39 Claims, 7 Drawing Sheets

(56) References Cited

U.S. PATENT DOCUMENTS

| | | | |
|---|---|---|---|
| 6,513,595 | B1 | 2/2003 | Freiheit et al. |
| 7,556,102 | B2 | 7/2009 | Gomez |
| 2007/0272411 | A1 | 11/2007 | Lopez de Cardenas et al. |
| 2011/0308817 | A1 | 12/2011 | Ravensbergen |
| 2013/0299200 | A1 | 11/2013 | Hughes |

FOREIGN PATENT DOCUMENTS

| | | |
|---|---|---|
| CA | 2713611 | 1/2011 |
| CA | 2738907 | 7/2011 |
| CA | 2766026 | 7/2011 |
| CA | 2788985 | 3/2013 |

* cited by examiner

WELLBORE TREATMENT TOOL AND METHOD

FIELD

The invention relates to a method and apparatus for wellbore treatment.

BACKGROUND

Wellbore completion operations require tools for fluid control and injections. For example, packers are employed to control fluid flows and to isolate and direct fluid pressures. In addition or alternately, fluid delivery tools may be employed to direct injected fluid into particular areas of the formation.

Wellbore fluid treatments may be for wellbore stimulation such as cleaning, acidizing or fracturing (also called fracing).

SUMMARY

In accordance with a broad aspect of the present invention, there is provided a wellbore treatment tool for setting against a constraining wall in which the wellbore treatment tool is positionable, the wellbore treatment tool comprising: a tool body including a first end formed for connection to a tubular string and an opposite end; a no-go key assembly including a tubular housing and a no-go key, the tubular housing defining an inner bore extending along the length of the tubular housing and an outer facing surface carrying the no-go key, the no-go key configured for locking the no-go key and tubular housing in a fixed position relative to the constraining wall, the tubular housing sleeved over the tool body with the tool body installed in the inner bore of the tubular housing; and a sealing element encircling the tool body and positioned between a first compression ring on the tool body and a second compression ring on the tubular housing, the sealing element being expandable to form an annular seal about the tool body by compression between the first compression ring and the second compression ring In accordance with another broad aspect of the present invention, there is provided a wellbore treatment assembly comprising: a liner installable in a wellbore, the liner including an inner bore defined within an inner wall, an outer surface, a first port extending from the inner wall to the outer surface, a first stop wall on the inner wall spaced axially from the first port, a second port extending from the inner wall to the outer surface spaced axially from the first port and a second stop wall on the inner wall spaced axially from the second port; a tubular string extendible through the liner and manipulatable from surface; and a wellbore treatment tool for setting against the inner wall of the liner including: a tool body including a first end formed for connection to the tubular string and an opposite end; a no-go key assembly including a tubular housing and a no-go key carried on the tubular housing, the tubular housing defining an inner bore extending from a first end to a second end of the tubular housing and an outer facing surface carrying the no-go key and the tubular housing sleeved over the tool body with the tool body installed in the inner bore of tubular housing; and the no-go key biased out to engage against the stop wall and to prevent the no-go key and tubular housing from moving downwardly past the stop wall; and a sealing element encircling the tool body and positioned between a first compression ring on the tool body and a second compression ring on the tubular housing, the sealing element being expandable to form an annular seal about the tool body by setting the no-go key against the stop wall and pushing the tool body down to compress the sealing element between the first compression ring and the second compression ring.

Also provided is a method for treating a formation accessed through a liner port in a wellbore, the method comprising: running into the wellbore with a wellbore treatment tool connected to a tubing string, the wellbore treatment tool including a tool body including a first end formed for connection to a tubular string and an opposite end; a no-go key assembly including a tubular housing and a no-go key, the tubular housing defining an inner bore extending along the length of the tubular housing and an outer facing surface carrying the no-go key, the no-go key configured for locking the no-go key and tubular housing in a fixed position relative to the constraining wall, the tubular housing sleeved over the tool body with the tool body installed in the inner bore of the tubular housing; and a sealing element encircling the tool body and positioned between a first compression ring on the tool body and a second compression ring on the tubular housing, the sealing element being expandable to form an annular seal about the tool body by compression between the first compression ring and the second compression ring; positioning the wellbore treatment tool with the sealing element positioned downhole of the liner port; compressing the wellbore treatment tool to expand the sealing element to set the annular seal downhole of the liner port; and pumping a wellbore treatment fluid into the wellbore uphole of the annular seal and through the liner port into the formation It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings:

FIG. 5 is a sectional view along a long axis of a wellbore assembly including the wellbore fluid treatment tool of FIG. 2 operating in a wellbore string. The treatment tool is shown after the position of FIG. 4 and with a fluid treatment being conducted there through;

DETAILED DESCRIPTION OF VARIOUS EMBODIMENTS

The description that follows and the embodiments described therein are provided by way of illustration of an example, or examples, of particular embodiments of the principles of various aspects of the present invention. These examples are provided for the purposes of explanation, and not of limitation, of those principles and of the invention in its various aspects. The drawings are not necessarily to scale and in some instances proportions may have been exaggerated in order more clearly to depict certain features. Throughout the drawings, from time to time, the same number is used to reference similar, but not necessarily identical, parts.

A wellbore fluid treatment tool, assemblies and methods for wellbore operations have been invented. Pluralities of embodiments are disclosed herein but they have common features that may facilitate and increase reliability of a wellbore fluid treatment operation.

Figure 1:
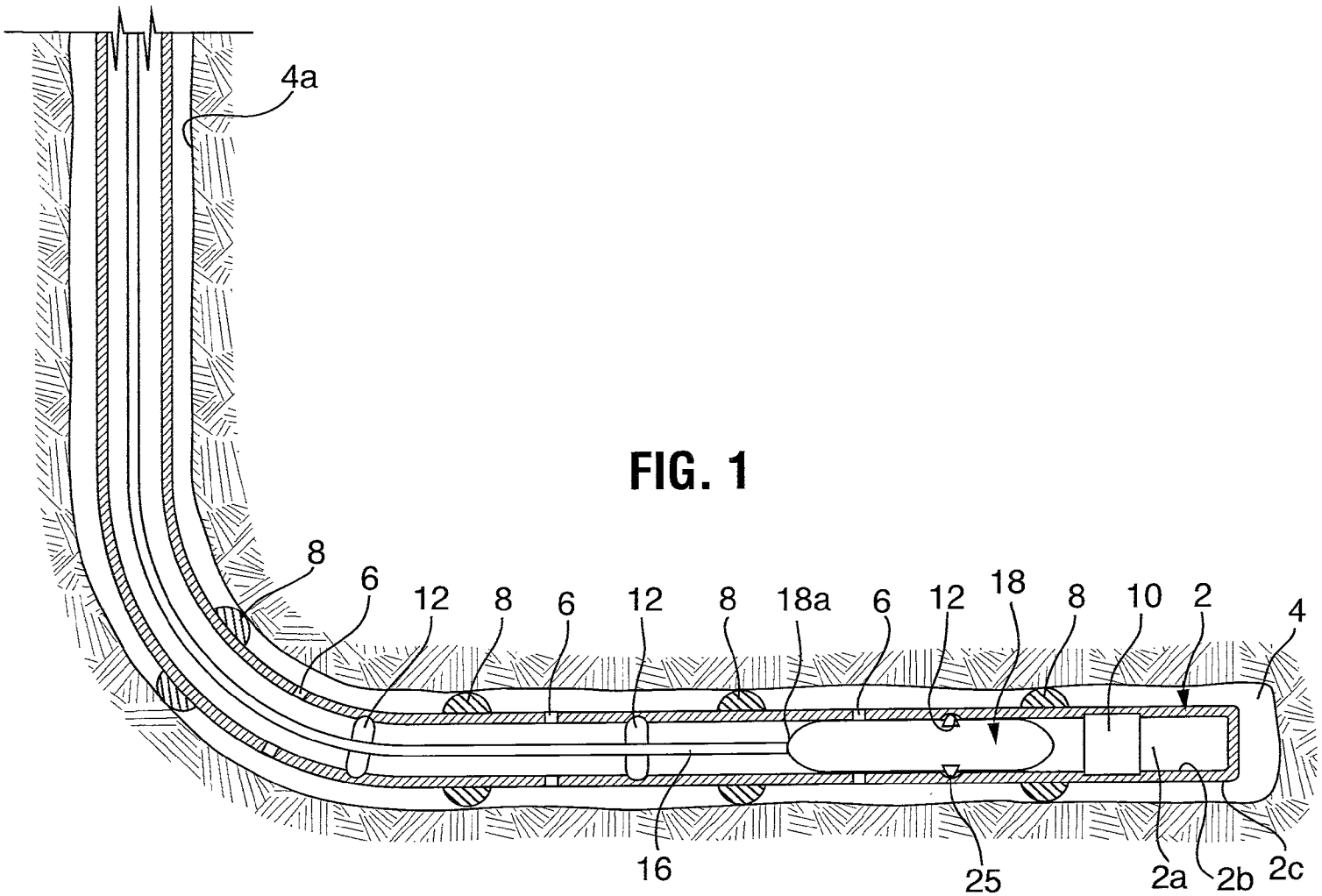
FIG. 1 is a schematic, sectional view along a long axis of a wellbore with a liner and wellbore fluid treatment tool installed therein.
Figure 2:
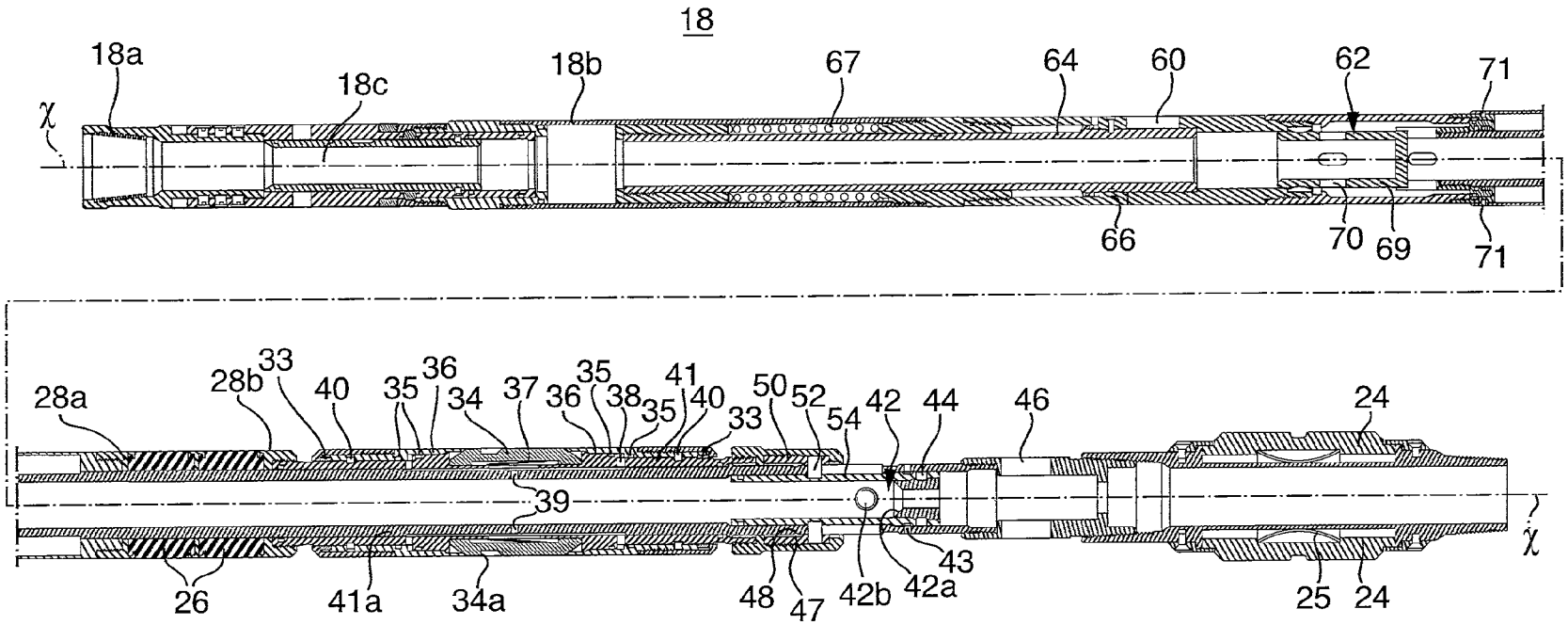
FIG. 2 is a sectional view along the long axis of a wellbore fluid treatment tool in an inactive, run in condition.
Figure 3:
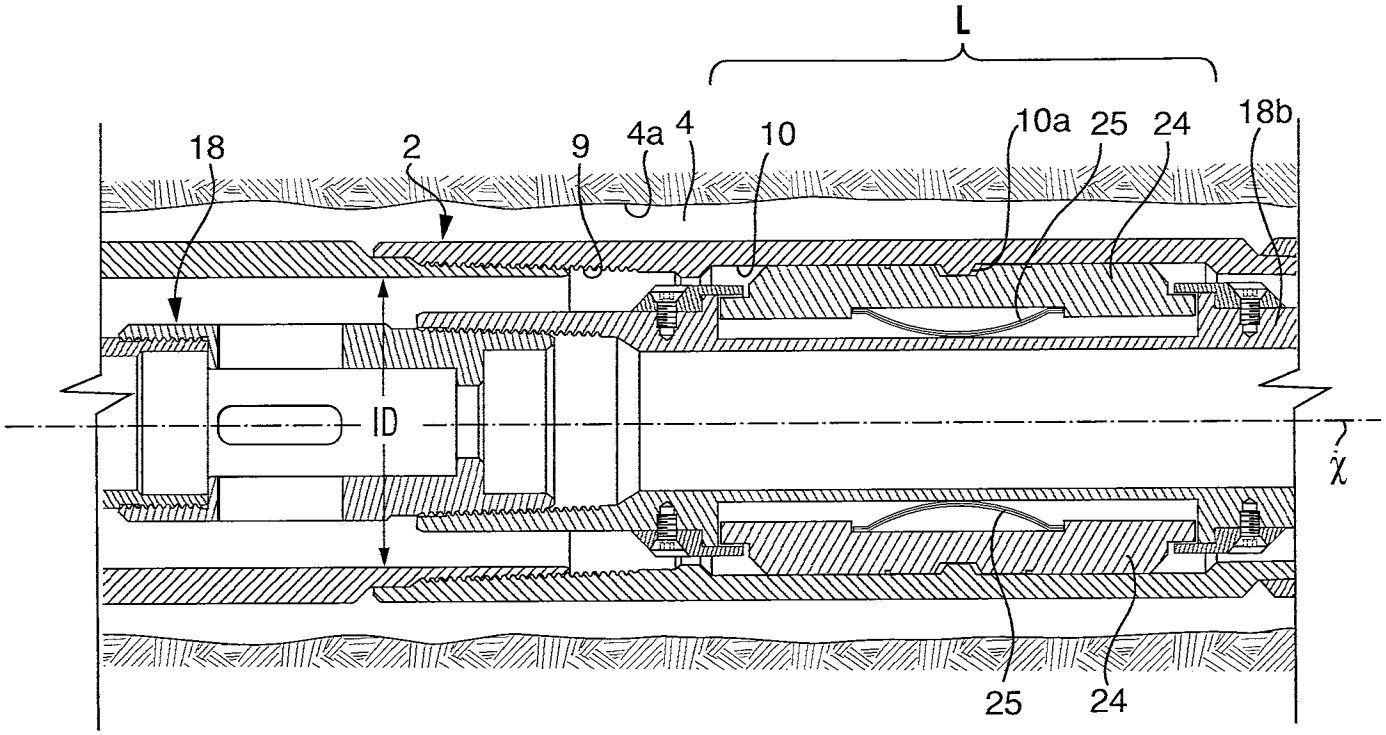
FIG. 3 is a sectional view along a long axis of a wellbore assembly including the wellbore fluid treatment tool of FIG. 2 operating in a wellbore string. The treatment tool is shown engaged in a marker joint.
Figure 4:
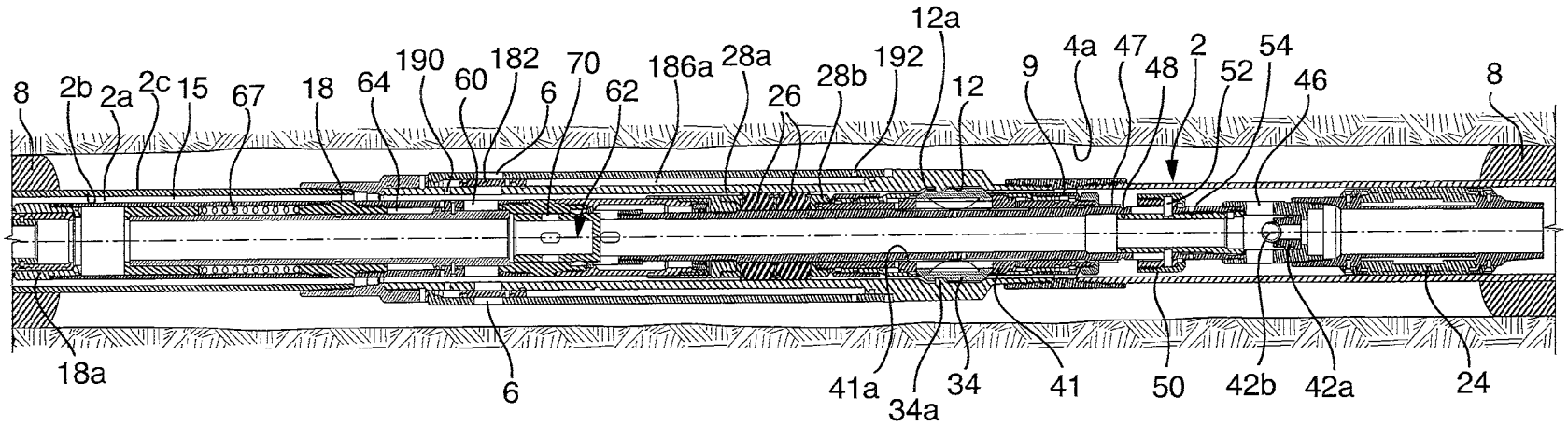
FIG. 4 is a sectional view along a long axis of a wellbore assembly including the wellbore fluid treatment tool of FIG. 2 operating in a wellbore string. The treatment tool is shown after the position of FIG. 3 and in a sealing position, ready to begin a fluid treatment.
Figure 5:
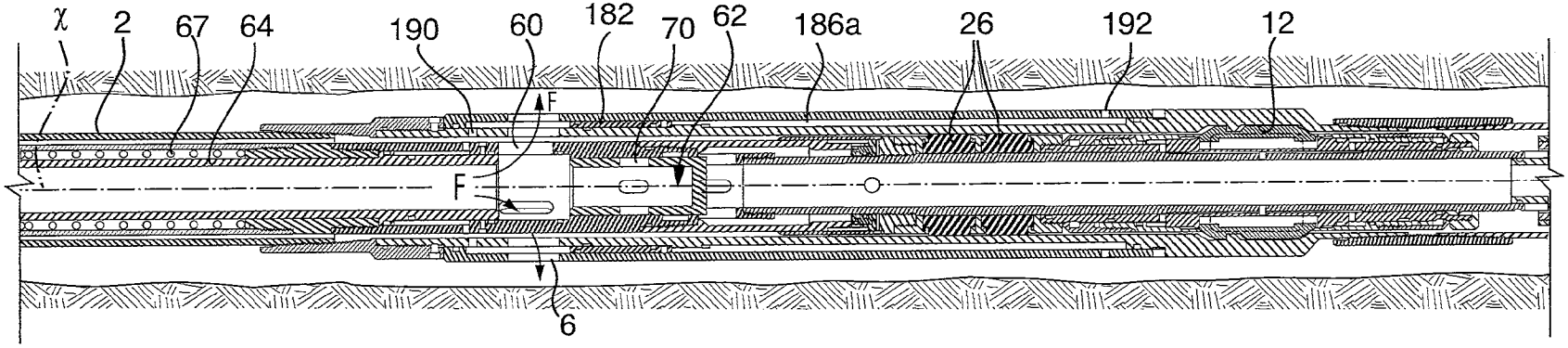

With reference to FIGS. 1 to 5, one embodiment of a wellbore fluid treatment assembly is shown. These figures show the assembly including a wellbore treatment tool 18 and a wellbore tubular liner 2, in which the wellbore fluid treatment tool may be positioned for operation. As noted FIG. 1, shows a schematic view of a tool 18 in position in a liner 2 within a wellbore 4. FIG. 2 shows fluid treatment tool 18 in an inactive condition, apart from the liner. This is the condition the tool is in during run in. FIGS. 3 to 5 show the wellbore assembly including the wellbore fluid treatment tool 18 operating in liner 2.

Wellbore tubular liner 2 and wellbore fluid treatment tool 18 have features that permit operation to selectively fluid treat a wellbore 4 in which the liner is positioned, permit reliable placement of wellbore fluid treatment tool 18 within liner 2 and permit setting of a seal element 26 on the tool by simple manipulation of the tool relative to liner 2. These features offer many benefits over the prior art.

Liner 2 may be installed in wellbore 4 and the liner then provides a conduit through which the wellbore may be selectively treated. The liner may be installed in a cased wellbore or in an open hole wellbore, wherein the formation is exposed and forms wellbore wall 4*a*, as shown.

Liner 2 may include a plurality of fluid treatment ports 6 through its wall. The ports extend from the inner bore 2*a* defined within inner wall 2*b* of the liner to its outer surface 2*c* facing wellbore wall 4*a*.

Liner 2 may be installed in the wellbore in various ways. Liner 2 may, for example, be cemented in the wellbore or it may be deployed with packers 8 and set in the wellbore by expansion of the packers. Packers 8 may be carried on the liner and, when set, may fill the annular area to separate the annular area between outer surface 2*c* and wellbore wall 4*a* into fluid-isolated segments. One or more of fluid treatment ports 6 may open into each isolated segment.

Tool 18 is formed to fit within inner wall 2*b* which forms a constraining wall about the tool and tool 18 can move through liner 2. Tool 18 may be carried, via its upper end 18*a*, on a manipulation string 16, through which the tool 18 can be axially moved and manipulated from surface. String 16 may have a solid or a tubular form. String 16, for example, may include rods, coil tubing, interconnected tubulars, etc. If fluid is to be conveyed from surface through string 16 to tool 18, the string will, of course, require a tubular form.

To facilitate positioning of the tool 18 in the liner, a marker profile 10 may be provided on inner wall 2*b*. As best shown in FIG. 3, marker profile 10 may be an annular indentation in the liner wall with a particular shape to accept therein a matching, outwardly biased marker key 24 on tool 18. Marker profile 10 may be positioned downhole of all ports 6 of interest in the liner and, if desired, the location of marker profile 10 within the well may be known (as by counting the liner joints installed above the joint accommodating marker profile 10, as the liner is installed: called "pipe tally"). Tool 18 may be run in until key 24 locates in marker profile 10 providing a reference indication of the tool's position in the well. When the key is located in its profile 10, a correlation can be made between tool depth and liner depth.

Key 24 is selected to match and engage with marker profile 10. Marker profile 10 may have a shape dissimilar to other liner profiles, such as collar gaps 9 (aka J-spaces), port location profiles 12 (to be described hereinafter), etc. Thus, key 24 catches properly only in marker profile 10. For example, marker profile 10 can have a shape, for example, a length, dissimilar to other liner profiles. In the illustrated embodiment, for example, marker profile 10 is an axial indentation in wall 2*b* and the axial indentation has an axial length L longer than any other profile in the liner. In the illustrated embodiment, marker profile 10 also has a unique axial shape with a raised portion 10*a* bisecting the axial length L.

Marker profile 10 has a diameter larger than the normal inner diameter ID of the wellbore wall. Marker key 24, to land in the marker profile, may have an axial length shorter than the profile's axial length L and conforms to other shape parameters of profile 10, such that the key can expand into the profile, when the key is aligned with the profile.

While the above description refers to a single key 24, the key, as shown, may actually contain a plurality of keys at the same axial location along tool body 18*b* and marker profile 10 may be formed as an annular indentation (i.e. a cylindrical indentation in wall 2*b*). This arrangement permits the overall key in profile engagement to be circumferential around the tool such that the engagement in the annular profile is not dependent on the rotational orientation of the tool.

Marker key 24 is biased outwardly from the tool body 18*b* by spring 25, but can collapse against the bias of spring 25, if sufficient force is applied. Profile 10 may be a depth such that extra force is required to push key 24 out of the profile than what is required to move the key along the liner wall 2*b*. Key 24 and profile 10 have chamfered ends so that the key can ride out of the locator profile, but extra force is required to do so.

To treat the well, fluids may be pumped through ports 6 and, thereby into contact with the formation at wall 4*a*. Tool 18 serves to direct fluid to a selected port. To do so, tool 18 is moved through liner 2 to a position adjacent the selected port 6 and the tool is then manipulated to direct fluid to that selected port. Tool 18 may then be manipulated to set a seal in the liner, as by use of an annular sealing element 26 to divert fluid to ports 6.

If a marker profile 10 is employed, ports 6 in the liner may each be a known distance from the marker profile. Thus, once tool 18 is positioned in marker profile 10, movement of the tool through the known distances positively positions the tool adjacent the ports 6.

A locator profile 12 may be provided in the liner inner wall 2*b* adjacent each port 6 or group of ports in the liner. Locator profile 12 may be formed as an indentation in wall 2*b* and profile 12 may have a particular shape to accept therein a matching, outwardly biased no-go key 34 on tool 18. Again, profile 12 may be annular and key 34 may be plural to provide a circumferential effect and eliminate the need for rotational alignment between tool 18 and liner 2. Each port 6 adjacent which the tool 18 is to act, may have a locator profile 12 close by and possibly each port 6 is a known position and distance from its profile 12.

Locator profiles 12 may each have a similar shape, but a shape dissimilar to other liner profiles, such as collar gaps 9, marker profile 10, etc. Thus, key 34 catches properly only in the locator profiles 12. For example, locator profile 12 can have a shape, for example, a length or pattern dissimilar to other liner profiles. In the illustrated embodiment, for example, locator profiles 12 each are an annular indentation in wall 2*b* and each have an axial length longer than standard profiles but shorter than any marker profile 10 in the liner. Also, locator profiles 12 each further have a raised portion that forms a unique pattern along the length. Key 34 is formed to fit into profile 12.

In addition to use as a positioning reference, locator profile 12 may also have a form that securely engages no-go key 34 such that the tool can be securely engaged in the liner at the position of profile 12. In particular, locator profile 12 may be formed with a no-go wall 12*a*, which presents an abrupt return wall that an abruptly angled shoulder 34*a* of key 34 cannot readily pass. Thus, when key 34 is moved out to engage in profile 12, the key cannot pass out of the profile in a direction where shoulder 34*a* must move past wall 12*a*. Through the "no-go" engagement of key 34 in profile 12, a force can be generated in tool 18. For example, when key 34 is engaged in profile 12 and shoulder 34*a* is set against stop wall 12*a*, force can be applied through tool 18 to liner 2 and continued force in the same direction can be generated, for example, to drive operation of tool 18.

In the illustrated embodiment, wall 12*a* and shoulder 34*a* are formed to stop key 34 from moving downwardly through profile 12. In particular, wall 12*a* faces uphole toward surface and shoulder 34*a* faces down toward the lower end of the tool. Thus, engagement of key 34 in profile permits the generation of compressive force in the tool, as by pushing down on the tool relative to the profile, which may include applying a pushing force through string 16 or simply by slacking off the string supports to place the weight of the tool 18 and manipulation string 16 onto key 34, as it is engaged against wall 12*a*.

While wall 12*a* and shoulder 34*a* are formed to stop key 34 from moving downwardly through profile 12, the other ends of the key/profile are formed to permit key 34 to be pulled up out of engagement with profile 12. For example, keys can have an upwardly facing chamfered end to facilitate movement of the key upwardly out of profile 12. As will be appreciated then, when key 34 is activated, the illustrated tool 18 can move in one direction (i.e. upwardly) through profiles 12, but not in the other direction (i.e. downwardly) through the profiles.

The outer face of key 34 may be substantially smooth such that the key can ride readily along the inner wall. Key 34 may be devoid of surface roughening and is devoid, for example, of teeth. Thus, key 34 does not act as a slip or drag block. However, key 34, when activated, readily expands out into a locator profile and cannot move downwardly past the stop wall of the locator profile so that compressive force can be established in the tool.

The engagement of key 34 in a profile 12 serves both for precise locating of the tool relative to a port and compressive operation of the tool.

Since liner 2 may contain more than one locator profile 12 and all profiles 12 are formed to accept engagement therein of no-go key 34 on tool 18, key 34 may have (i) an inactive condition where it is retained from engagement with profiles 12 and (ii) an active condition where key 34 can engage in locator profiles 12. The above-noted provision of an inactive condition for key 34 permits free movement of the illustrated tool 12 in both directions past the profiles, when desired.

The activation of key 34 from the inactive condition to the active condition can be by various means. In the illustrated embodiment, this activation of key 34 from inactive to active is achieved by a mechanical system or hydraulics. A mechanically activated system for the no-gos, could involve a continuous j-slot and jay pin. After locating in the marker joint, the tubing could be reciprocated navigating the jay pin through the j-slot.

This action may trigger the no-go key from the dormant, inactive position to the active position. As shown in the illustrated embodiment, hydraulics are employed, as permitted by a controller. For example, key 34 is retained in the inactive condition by one or more restraining pistons 36. Restraining pistons 36 overlie the key 34 and hold it recessed in a cavity on a key housing 41, but key 34 is biased against pistons 36 by a spring 37. Restraining pistons 36 are moveable to a retracted position away from key 34, by hydraulic pressure communicated to a hydraulic chamber 38 open to pistons 36. Tool 18 includes an inner bore 18*c* extending from upper end 18*a* through which hydraulic fluid may be communicated from string 16. Hydraulic delivery channels 39 extend from bore 18*c* to chamber 38. Seals 35 hold hydraulic pressure in chamber 38 and direct the pressure against pistons 36. Locks 33 carried on pistons 36 may secure the pistons in their retracted positions.

A controller ensures that only certain pressures are sufficient to drive activation of the keys. The controller includes a releasable holding mechanism, such as shear pins 40, on pistons 36 and a valve 42 in the bore 18*c* to control diversion of pressures to chamber 38. Valve 42, in this embodiment, includes a ball seat 42*a* sized to seal with a ball 42*b* in bore 18*c*. Seat 42*a* and ball 42*b* create a one way check valve permitting flow upwardly through tool but resisting fluid flow down past seat 42*a*. The valve, however, can be inactivated when desired. For example, seat 42*a* is releasable, for example, via release of shears 43 and collapse of detents 44, to move past an opening 46 between bore 18*c* and the outer surface of the tool body. Note the active position of ball seat 42*a* in FIG. 2 compared to the inactive position of the ball seat in FIG. 4. Once ball seat 42*a* is positioned below openings 46, fluid can flow out of bore 18*c* into liner 2 without control by valve 42.

As noted above, tool 18 further includes sealing element 26 for operation to divert fluid to ports 6 to treat the wellbore. In this tool, sealing element 26 is settable/releasable such that it can be set to create a seal and then released to allow the tool to be moved. The sealing element 26 can be set and released a plurality of times and in different locations, without being tripped to surface.

Sealing element 26 is set by compressive force, which moves compression rings 28*a*, 28*b* toward each other and compresses therebetween the sealing element to extrude it outwardly. Compressive force can be generated in the tool, by engaging key 34 in profile 12, as described above.

Compressive force can be directed to sealing element 26 by releasing key housing 41 to be slidably moveable over tool body 18*b*, which acts as a mandrel for key housing 41. Key housing 41 carries key 34 and these parts move together axially. Tool body 18*b* is formed to extend through an inner diameter 41*a* of key housing 41 and tool body 18*b* is slidably moveable in the inner diameter of housing 41, when the housing and the tool body are released.

When the key housing 41 and tool body 18*b* are released for slideable movement and compressive force is introduced to the tool, tool body 18*b* can be driven down through key housing 41, as it remains secured via key 34 in profile 12. Compression ring 28*a* is secured and moveable with body 18*b* and compression ring 28*b*, on the other side of element 26, is secured and moveable with key housing 41. Thus, movement of tool body 18*b* down through key housing 41 drives compression, and therefore extrusion and setting, of element 26.

To avoid inadvertent setting of sealing element 26, key housing 41 and tool body 18*b* can only move relative to each other when released to do so. While there are various means for releasably locking the parts together, housing 41 and tool body 18*b* are locked together via a collet connection with collet dogs 47 on one part (in this case housing 41) that lock into a recess 48 on the other part (in this case tool body 18*b*). Collet dogs 47 are locked into engagement with recess 48 by a lock ring 50, but lock ring 50 is removable from over dogs 47 to allow them to pull out of the recess when the parts 41 and 18*b* are moved relative to each other.

Further in this illustrated embodiment, the release of the releasable lock is linked to deactivation of valve 42. In particular, lock ring 50 is connected to ball seat 42*a* to move therewith when ball seat 42*a* is moved. In this embodiment, lock ring 50 and ball seat 42*a* are connected through a pin 52 and a sleeve 54 in which seat 42*a* is installed.

When ball seat 42*a* is moved by a ball landing therein and applying a force capable of shearing shears 43, that movement is transferred to pin 52, which pulls lock ring 50 off dogs 47. Thus, deactivation of valve 42 and activation of seal 26 can occur through the same operation. Once lock ring 50 is moved away from dogs 47, tool body 18*b* can slide within housing 41 and the sealing element 26 can be set and unset by that movement. Note the relative positions of housing 41, body 18*b* and lock ring 50 and the condition of sealing element 26 in FIG. 2 compared to the positions of those parts and the expanded condition of seal 26 in FIG. 4.

Tool body 18*b* carries seal element 26 and no-go key 34 in close proximity and, therefore, is relatively short.

In FIGS. 1 to 5, tool 18 is configured to convey a wellbore treatment through string 16 and bore 18*c*. As such, tool 18 includes fluid delivery ports 60 through the wall of tool body 18*b* and a valve 62 to control flow through bore 18*c* between ports 60 and opening 46.

Ports 60 provide a fluid flow path from bore 18*c* to the outer surface of the tool such that fluid, for example wellbore treatment fluid, can be delivered from surface through string 16 into bore 18*c* and then to liner 2 above sealing element 26. Since tool 18 requires pressure actuations, for example of key 34, ports 60 are normally closed but selectively openable. In this illustrated embodiment, a sleeve valve 64 is movably mounted on the tool to close and open the ports. Sleeve valve 64, as illustrated, is held closed by shears 66 but can be opened by pressure differentials where the pressure external to the tool is greater than the pressure in bore 18*c*. A spring 67 is provided to drive sleeve 64 open as soon as the pressure differential is capable of overcoming shears 66. Note the relative position of sleeve valve 64 in FIG. 4 compared to that in FIG. 5.

Valve 62 controls flow through bore between ports 60 and opening 46. Since tool 18 requires pressure actuations below ports 60, but is also operable to deliver treatment fluid through ports 60, a valve 62 is provided that is operable to permit or stop flow through bore 18*c* below ports 60. Because flow may not be of interest after activation of the tool, valve 62 could be first open and then permanently closed. However, the ability to move valve 62 repeatedly between open and closed positions may be of interest for pressure equalization, flushing, to facilitate movement, etc. In the illustrated embodiment, valve 62 is actuated between open and closed positions by compression and release of compression in the tool. In particular, valve 62 may be incorporated in a telescoping portion of tool body 18*b*. Valve 62 may include a telescoping sleeve including ports 70 that are open when body 18*b* is in tension, but close when body is compressed. Compression of the tool shifts sleeve 69 into a section of bore 18*c*. Valve 62 may initially be held against telescopic movement by a releasable lock such as detents, shear pins 71, etc., but these are overcome when the body is pushed into compression. Note that valve 62 is open in FIG. 2, which is the run in condition of the tool and in FIG. 4, valve 62 is closed.

The tool can include other features such as a disconnect 74. The illustrated disconnect is a mechanical hydraulic disconnect, but other configurations are possible.

Tool 18, by setting sealing element 26, may be used to isolate an upper portion of the liner from a lower portion thereof. With the ports 60, the tool may be used to both isolate and pressure effect an area along the wellbore. For example, tool 18 may be employed to isolate and fluid treat a wellbore by being set adjacent a port 6, setting the sealing element 26 below port 6 to create a seal in the liner and then directing fluid out through ports 60, into the liner and then through ports 6 into contact with the formation. The annular area 15 between tool 18 and liner 2 may be pressured up to prevent fluid from circulating up through the annulus rather then passing through the ports 6. The tool can be run in to the position adjacent port 6 in an inactive condition, but activated downhole to set the seal, etc.

As noted above, the sealing element of the present tool is set by compression. Tool 18 works with locator profiles 12 to permit compressive force to be generated in the tool.

Locator profiles 12 may be used to ensure proper positioning of the tool in the well by positioning a profile adjacent a position in the well in which it is desired to set the sealing element. For example, the tool may be intended to treat the formation through a port 6 and a locator profile 12 may be axially spaced from the port with consideration as to the compressed distance between element 26 and no-go key 34 such that when key 34 is located in the locator profile and the tool is compressed, element 26 is set below (i.e. downhole of) port 6.

To more fully appreciate operational options of the presently described embodiment, note that a liner is run into the well with a marker profile 10 and locator profiles 12 on inner wall 2*b*. As noted above, liner 2 may be cemented into the well or installed in open hole. Each locator profile 12 is a known distance uphole from marker profile 10 and each profile 12 is a known distance downhole from an associated port 6. The tool configuration and liner configuration can be correspondingly selected such that when the no-go key is located in a locator profile, the annular seal is positioned downhole of the associated port 6 and opposite a section of liner wall to accept the expansion of seal thereagainst. The liner and tool can each be relatively compact.

For use, tool 18 is first connected to string 16, which is formed of tubing. Tool 18 is run into liner 2 in an inactive condition, as shown in FIG. 1. In the inactive condition, neither no-go keys 34 nor sealing element 26 are expanded and, therefore, they do not drag along inner wall 2*b*. The tool can therefore be run in quickly, with little risk of adverse tool wear or stuck conditions. During run in, fluids can be reverse circulated through the tool.

During deployment marker keys 24, which are biased outwardly by springs 25, contact the liner's inner wall. However, keys 24 are shaped (i.e. sized and/or machined) such that they do not catch in other profiles in the liner. For example, keys 24 pass over locator profiles 12, j-spaces, etc. without catching therein. Eventually, the tool is moved by string 16 to a depth where marker keys 24 land in marker profile 10 (FIG. 3). At this point, keys 24 expand out and engage the matching profile 10. This engagement point is used as a reference to correlate tool depth to liner depth. Because the marker keys can only catch in one profile in the liner, the operator is assured of the position of the tool, when marker keys 24 catch in a profile.

After correlation of depths, pressure is applied to string 16. As valve 62 is open in the inactive, run in condition, fluid pressure is communicated down through bore 18*c*. This drives ball 42*b* to seal against seat 42*a* and tubing pressure can be increased. Eventually pressure, communicated through channel 39, increases in chamber 38 and shears pins 40 permitting restraining pistons 36 to move away from selective no-go keys 34. Springs 37 located below keys 34 exert a force on the keys to push them radially out from housing 41.

A further increase in pressure shears pins 43 and collapses detents 44 to pump seat 42*a* and ball 42*b* down past openings 46. This opens the bore to flow therethrough. The action of seat 42*a* being driven down also unlocks the collet connection, freeing the no-go key housing 41 from its fixed position on body 18*b* and triggering the sealing element into a compressible condition.

The tool is then fully activated. This can be done at any time before the tool is required to catch in the first profile of interest. Generally, activation occurs while the marker key remains in the marker profile or while the tool is at some point between the marker profile and the first locator profile of interest. Once the tool is activated, it remains active.

The tool can then be moved to engage keys 34 in a first locator profile 12 of interest (FIG. 4). Because the distances between marker profile 10 and profiles 12 are know, the location of the first locator profile can be determined by monitoring the distance moved by the tool. When keys 34 are located in a locator profile 12, shoulder 34*a* can be set against wall 12*a*. Shoulder 34*a* transfers compressive force into the liner. Increased compressive force packs off sealing element 26 to create a pressure tight seal between liner inner wall 2*b* and the outer surface of the tool. This compressive force also shears the releasable lock on valve 62 such that the valve ports 70 can be closed. This prevents fluid flow past valve 62 and with seal 26, communication from string 16 to the liner below the tool is restricted.

Once the tool has located with key 34 in profile 12, only a simple, single pushing force, such as slacking off weight on the tool, is required to achieve compression.

Applied annular pressure in annular area 15 can be increased to open ports 60. In particular, applied annular pressure shears screws 66 holding sleeve 64 in place, which allows spring 67 to shift the sleeve to the open position (FIG. 5). When this occurs, communication is established between the inside of string 16/bore 18*c* and annulus 15.

Applied pressure through string 16 causes a pressure increase in the annulus adjacent port 6 and the fluid can be used to treat the formation accessed at wellbore wall 4*a*.

Wellbore treatment fluid can be pumped down string 16, arrows F, and into contact with the formation. Circulation is prevented back up annulus 15 by closing an annulus wellhead valve. Also, annular space 15 may be pressured up to an amount substantially equal to the break down pressure of the formation.

When treatment is complete at port 6, tool 18 is pulled into tension. A straight up pull is all that is required to release the tool. This opens valve 62, allowing pressure to balance from end 18*a* to openings 46. Excess proppant or other debris that may have accumulated above valve 62 may be flushed into the liner below tool 18. After the pressure has balanced, seal 26 retracts to the unset position and tool 18 can be moved to another locator profile. Because the seal cannot retract before the tool is pulled into tension, the engagement of sealing element 26 against liner wall 2*b* ensures that valve 62 telescopes to open and tool body pulls up through key housing 41 to release the tension from element 26. The keys 34 remain in an active position and tool 18 cannot be moved down past that profile 12, but keys 34 can collapse inwardly against the bias in springs 37 to allow keys 34 to be pulled up toward surface.

The location of the next profile of interest can be determined by monitoring the distance moved by the tool and the tool will auto-locate in the next profile of interest because keys 34 match the shape of the profile. Again, compressive force transferred through the tubing string 16 into keys 34 and the shoulder of the profile against which the keys are engaged causes isolation seal 26 to expand out while closing valve 62. The formation at the port associated with the next profile of interest can be treated as noted above.

The tool remains active once activated and thus compression is all that is required to prepare the tool for a next treatment. Since tool 18 can only be compressed when located in a locator profile, the operator can precisely control tool operational positioning and seal expansion.

This process is repeated for all ports and profiles of interest. If the operator does not wish to treat a particular port, that port can be passed without treatment. The keys 34 land in the profile for that port but can be pulled through. Treatments through the skipped ports could be deferred or targeted in future re-entries or re-fracs.

Figure 6:
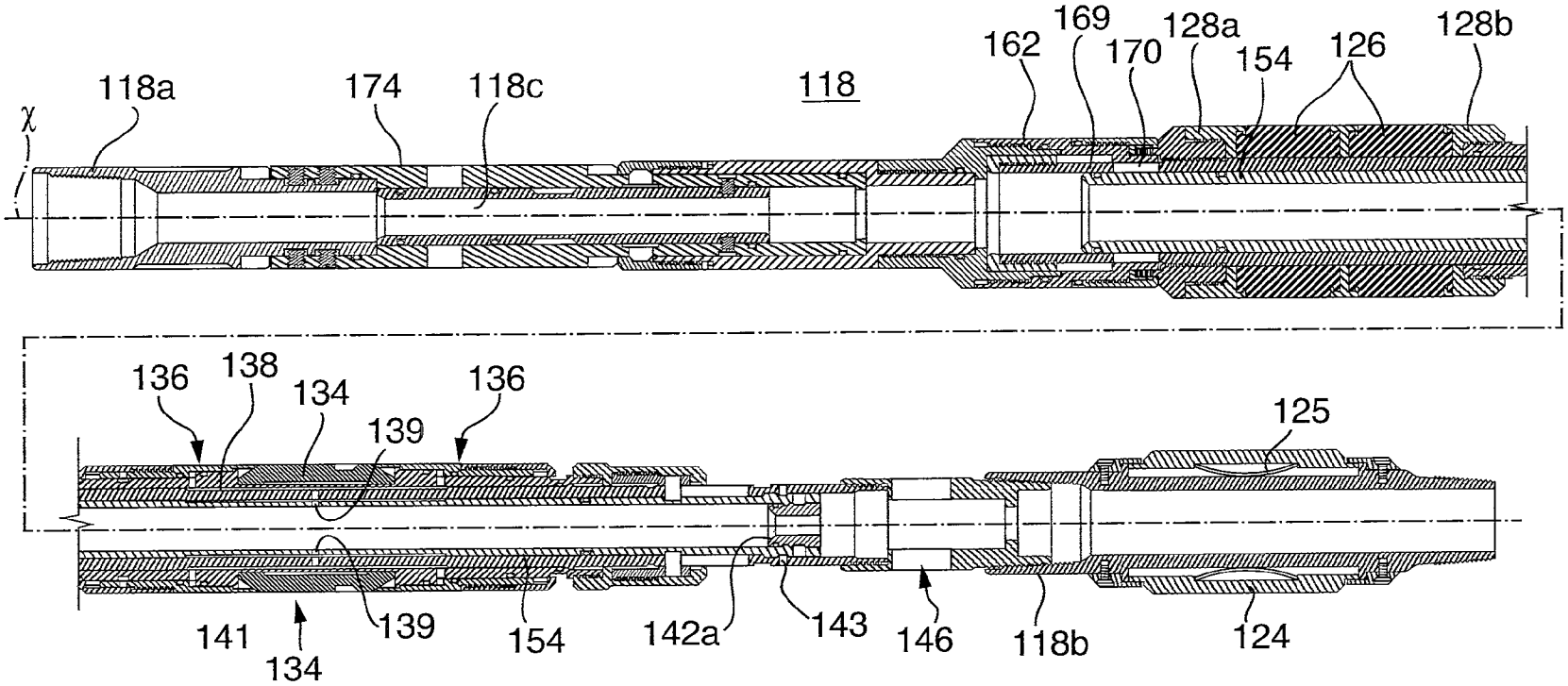
FIG. 6 is a sectional view along the long axis of another wellbore fluid treatment tool in an inactive, run in condition.

The tool of FIGS. 2 to 5 is for through-tubing treatments. Another tool embodiment is shown in FIG. 6, which is useful for annular fluid treatments. The tool 118 of FIG. 6 includes a tool body 118*b*, an upper end 118*a* of which is connectable to a manipulation string 116. A compression set sealing element 126 encircles long axis x of the tool body. Body 118*b* is formed to permit a compression thereof to set the sealing element 126. Keys 134 are carried on the tool to engage the liner 102 in which the tool is conveyed to permit a compressive force to be applied to the tool.

To treat the well, fluids may be pumped through ports 106 in liner 102 and, thereby into contact with the formation at wall 104*a*. Tool 118 serves to direct fluid to a selected port. To do so, tool 118 is moved through liner 102 to a position adjacent the selected port 106 and the tool is then manipulated to direct fluid to that selected port, as by setting seal element 126 to divert fluid to port 106.

Tool 118 is formed to fit within and move through a liner 102. Manipulation of string from surface string 116 moves the tool 118 axially through the liner. String 116 may have a solid or a tubular form. Since the illustrated tool includes features that are reactive to through tubing pressure, string 116 has a tubular form.

Optionally, tool 118 may include a marker key 124 capable of fitting within a marker profile (not shown). This key is as described above.

If desired and as described above, key 134 may be a no-go type key formed to engage no-go wall 112*a* in the liner inner wall 102*b*.

Since liner 102 may contain more than one stop wall 112, key 134 may have (i) an inactive condition and (ii) an active condition. The activation of key 134 is as described above, although other activation processes are possible as noted above.

Sealing element 126 is set by compressive force, which moves compression rings 128*a*, 128*b* toward each other and compresses therebetween the sealing element to extrude it outwardly. Compressive force can be generated in the tool, by engaging key 134 against stop wall 112*a*, as described above.

Because the tool is intended for annular treatments it does not require a port, such as port 60 of FIGS. 2 to 4, from its inner bore 118*c* to the outer surface. Also, a valve, such as valve 62 of FIGS. 2 to 4, is not required to seal off flow through bore 118*c* of the tool.

However a bypass valve 162 may be provided between upper end 118*a* and seal 126. Bypass valve 162 may be useful after a treatment has been conducted to pressure equalize above and below the sealing element and to permit debris to be flushed off the seal. Bypass valve 162 is closed during wellbore treatments but is openable when the tool is pulled into tension (FIG. 7) to unset the sealing element Bypass valve 162 is also closed during run in, as shown in FIG. 6, but can be activated when downhole to be openable when the tool is pulled into tension.

Various bypass configurations are possible. In the illustrated embodiment, valve 162 is incorporated in a telescoping portion of tool body 118*b*. Valve 162 may include a telescoping sleeve 169 including ports 170 that are open when body 118*b* is in tension (FIG. 7), but close when body is compressed (FIG. 6). Compression of the tool shifts sleeve 169 into a section of bore 118*c* where ports 170 are blocked.

During run in, valve 162 is inactive and cannot open. However, it may be activated when downhole, which in this embodiment is via the same process as that to activate keys 134. In particular, sleeve 169 can slide back and forth within bore 118*c* to expose and close ports 170 to outer surface. Shear pins may be employed to resist telescoping during run in. However, ports 170 are normally closed by an extension of sliding sleeve 154 in which ball seat 142*a* is installed. When ball seat 142*a* is moved by a ball (not shown) landing therein and applying a force capable of shearing shears 143, that movement is also moves sleeve 154 to expose ports 170 and, thereby, activate valve 162 to actually allow fluid flow or stop fluid flow by compression. Thus, activation of keys 134 and activation of bypass valve 162 can occur through the same operation and that operation is also the same as that to activate seal 126, as described above in reference FIGS. 2 to 4.

The tool can include other features such as a disconnect 174. The illustrated disconnect is a mechanical/hydraulic disconnect, but other configurations are possible. The disconnect is selected with a small outside diameter to avoid a blockage in the annular area 115 between tool 118 and wall 102*b*.

Tool 118, by setting sealing element 126, may be used to isolate an upper portion of the liner from a lower portion thereof. The tool may be positioned adjacent a port 106, sealing element 126 may be set to create a seal in the liner below port 106 and then a fluid treatment may be conveyed through annular area 115 and out through ports 106 into contact with the formation. The tool can be run in to the position adjacent port 106 in an inactive condition (FIG. 6), but activated (FIG. 7) downhole to set the seal, etc.

To more fully appreciate operational options of the presently described embodiment, note that in one embodiment, a liner is run into the well with a marker profile (not shown) and locator profiles 112 on inner wall 102*b*. Each locator profile 112 is a known distance uphole from the marker profile and each profile 112 has a similar stop wall 112*a* and is a known distance downhole from an associated port 106.

For use, tool 118 is first connected to string 116, which is formed of tubing. Tool 118 is run into liner 102 in an inactive condition, as shown in FIG. 6. In the inactive condition, no-go keys 134 and sealing element 126 are held in a retracted condition and, therefore, they do not drag along inner wall 102*b*. During deployment marker keys 124, which are biased outwardly by springs 125, contact the liner's inner wall. However, keys 124 are shaped (i.e. sized and/or machined) such that they do not catch in other profiles. For example, keys 124 pass over locator profiles 112 without catching therein. Eventually, the tool is moved by string 116 to a depth where marker keys 124 land in the marker profile. At this point, keys 124 expand out and engage the matching shape of the marker profile. This engagement point is used as a reference to correlate tool depth to liner depth.

During run in, fluids can be forward or reverse circulated through the tool.

When the tool is downhole, the tool is activated before it is required for the first wellbore treatment. To do so, pressure is applied to string 116 and that fluid pressure is communicated down through bore 118*c*. A ball may be dropped from surface to seal against seat 142*a* and tubing pressure can be increased above seat 142*a*. Eventually pressure, communicated through channel 139, increases in chamber 138 and shears shear screws permitting restraining pistons 136 to move away from selective no-go keys 134. Springs located below keys 134 exert a force on the keys to push them radially out from housing 141.

A further increase in pressure pumps seat 142*a* and its ball down past openings 146. This opens the bore again to flow therethrough from upper end 118*a* to openings 146. The action of seat 142*a* being driven down also (i) moves sleeve 154 to activate bypass valve 162 and (ii) unlocks the collet connection, freeing the no-go key housing 141 from its fixed position on body 118*b*, allowing the sealing element to be compressed by appropriate action of the tool body relative to the key housing. The tool is then fully activated.

The tool can then be moved to engage keys 134 in a first locator profile 112 of interest. Because the distances between the marker profile and profiles 112 are know, the location of the first profile can be determined by monitoring the distance moved by the tool. When keys 134 are located in a locator profile 112, shoulder 134*a* can be set against wall 112*a*. Shoulder 134*a* transfers compressive force into the liner. Increased compressive force packs off sealing element 126 to create a substantially pressure tight seal between liner inner wall 102*b* and the outer surface of the tool. This compressive force also closes valve 162 such that there is no communication between annular area 115 and inner bore 118*c* and, thus, with seal 126 now expanded, the upper liner is isolated from the lower liner.

Applied annular pressure from surface then can move through annular area 115 and is diverted by seal 126 through ports 106 and into contact with the formation to provide a wellbore treatment.

Figure 7:
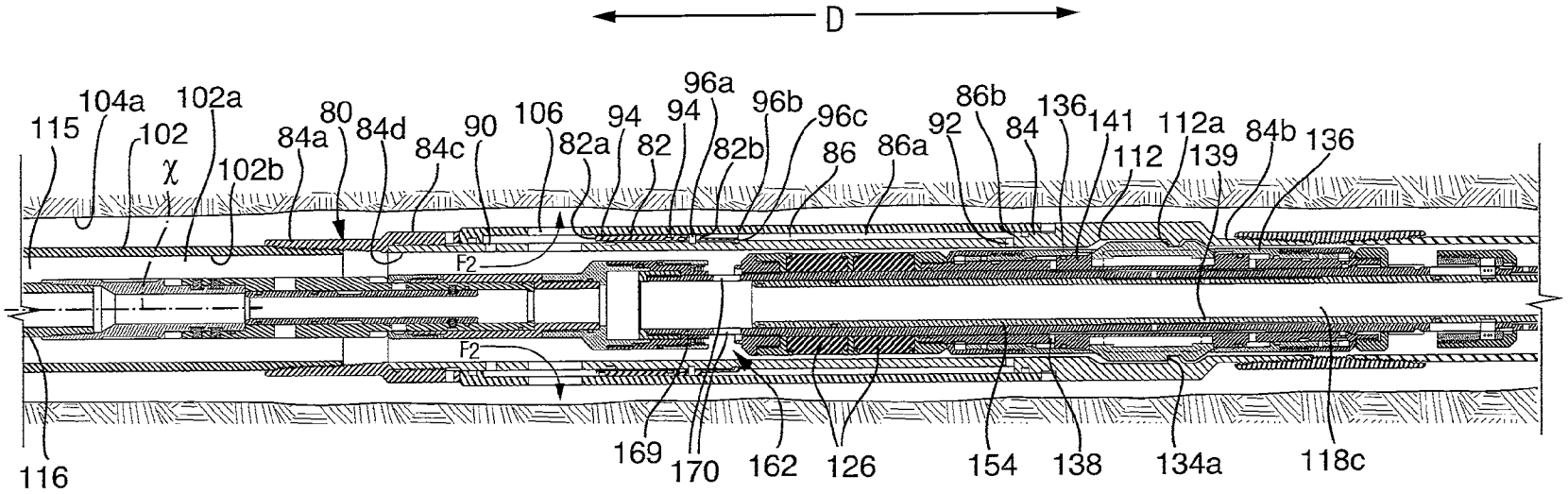
FIG. 7 is a sectional view along an upper portion of a wellbore assembly including the wellbore fluid treatment tool of FIG. 6 operating in a wellbore string. The treatment tool is shown after a fluid treatment.

When treatment is complete at port 106, tool 118 is pulled into tension. This opens valve 162, allowing pressure to balance from end 118*a* to openings 146. Excess proppant or other debris that may have accumulated above seal 126 may be flushed through valve 162 and bore 118*c* into the liner below tool 118. After the pressure has balanced, seal 126 retracts to the unset position (FIG. 7). Tool 118 can then be moved up to another locator profile. The keys 134 remain in an active position and tool 118 cannot be moved down past that profile 112 or any other stop wall 112*a*, but keys 134 can collapse inwardly against the bias in springs 137 to allow keys 134 to be pulled up out of a profile toward surface.

The location of the next profile of interest can be determined by monitoring the distance moved by the tool and the tool will auto-locate in the next profile of interest because keys 134 match the shape of the profile. Again, compressive force transferred through the tubing string 116 into keys 134 and the shoulder of the profile against which the keys are engaged causes isolation seal 126 to expand out while closing valve 162. The formation at the port associated with the next profile of interest can be treated, as noted above.

This process is repeated for all ports of interest. If the operator does not wish to treat a particular port, it can be passed without treatment. The keys 134 land in the profile for that port but can be pulled through.

In the present system, burst disks or shiftable sleeves can close ports 6, 106. The tool may be employed to pressure effect ports 6, 106 (i.e. burst the disk, hydraulically open the sleeve, etc.) and/or to pressure effect the formation accessed through the port at that area of the wellbore (i.e. to pump fluid through the port into contact with the formation).

For example, tool 18, 118 may be set adjacent a port with a burst disk therein. Element 26, 126, being set below the perforations, seals the tool against the liner such that fluid pressures can be built up in the annular area at the port. Pressure applied through the tool or through the annular area can be used to rupture the burst disk and open communication with the formation. Stimulation fluid can then be pumped through the port opened by bursting the disk to access the formation.

The tools can also be employed to open a hydraulically shifted wellbore valve, such as one having a piston such as a sleeve or poppet and possibly thereafter to inject fluid into the formation accessed behind the wellbore valve. While many such wellbore valves may be employed, one particularly useful valve sub 80 is shown in FIG. 7.

The valve sub 80 includes a hydraulically driven piston member, which herein is a sleeve 82 but may take other forms such as non-cylindrical sleeves, poppets, pocket pistons, etc., installed in a tubular wall 84. The sleeve may be installed such that a pressure differential can be established across the sleeve, between its ends 82*a*, 82*b*, and it can be moved as a piston. The sleeve, for example, may be installed in the wall with a pressure communication path accessing one end 82*a* of the sleeve and another, separate pressure communication path accessing the other end 82*b* of the sleeve.

In one embodiment, for example, tubular wall 84 can include an upper end 84*a* and a lower end 84*b*. The tubular wall may be formed for connection into a string, such as by forming ends 84*a*, 84*b* as threaded pins or boxes. The tubular wall has an outer surface 84*c* and an inner facing surface 84*d* which defines therewithin a bore, which in the drawings is open to the bore 102*a* of the liner 102.

Wall 84 includes chamber 86 formed therein between outer surface 84*c* and inner facing surface 84*d* and sleeve 82 is positioned in the chamber. Chamber 86 is formed such that sleeve 82 can slide axially in chamber, except as limited by releasable locking structures if any. Since in this embodiment, the sleeve has a cylindrical structure, chamber 86 herein has an annular form following the circumference of the tubular wall.

Port 106 extends through wall 84 passing through annular chamber 86. Port 106 provides fluid communication between bore 102*a* and outer surface 84*c*, which is placeable in communication with a wellbore wall 104*a*, and therethrough a formation, when the sub is installed in a string and the string is installed in a wellbore. Formation communication port 106 is actually two openings, one through the wall thickness between inner facing surface 84*d* and chamber 86 and the other through the wall thickness between chamber 86 and outer surface 84*c*, but these two openings can be collectively considered as port 106 through which fluids may be communicated between inner bore 102*a* and outer surface 84*c*.

Sleeve 82 is positioned to open and close port 106. For example, sleeve 82 can be placed in a position in annular chamber 86 to close port 106, wherein the sleeve spans across the port, and sleeve 82 can be placed in a position in the annular chamber wherein it is retracted from across the port, wherein port 106 is open to fluid flow therethrough. Sleeve 82 is moveable within chamber 86 between a closed port position and an opened port position. As noted above, sleeve 82 may be moved from the closed port position to the opened port position by generating a pressure differential between ends 82*a* and 82*b* of the sleeve. Chamber 86 is sized to accommodate this movement having an enlarged space on at least one side of the sleeve into which sleeve 82 can move.

An opening 90 is provided from bore 102*a* to chamber 86 where it is open to end 82*a* of the sleeve and another opening 92, that is separate and spaced from opening 90, is provided from bore 102*a* to chamber 86 where it is open to end 82*b* of the sleeve. Thus, pressure can be communicated from bore 102*a* to the ends of the sleeve through ports 90, 92 to create a pressure differential across the sleeve. In the illustrated sub, sleeve 82 is configured to open by moving down toward end 84*b*. Chamber 86 has an enlarged space 86*a* between port 106 and end 84*b* that is sized to accommodate sleeve 82 when it is moved from across port 106. Chamber 86 may further have an end wall 86*b* positioned between port 106 and end 84*b*. Opening 90, which communicates the opening pressure to chamber 86 is positioned between port 106 and end 84*a*. Opening 92, which acts as a vent from chamber 86 to prevent a pressure lock as the sleeve moves, is positioned between port 106 and end 84*b*. As will be appreciated, if chamber 86 is closed except for opening 92, a pressure lock would occur if sleeve 82 was sought to be moved beyond opening 92. Thus, opening 92 is spaced sufficiently from port 106, for example a length corresponding to at least the length of the sleeve, to permit the sleeve to move through chamber 86 to open the port. In one embodiment, opening 92 is positioned well on the opposite side of space 86*a* from port 106, close to end wall 86*b*. When a pressure differential is established between opening 90 and opening 92, these pressures are communicated to ends 82*a*, 82*b* of the sleeve, respectively, and the sleeve will move to the lower pressure side.

Opening 90 and port 106 are spaced from opening 92 with a length D of inner facing wall 102*b* between them. The sleeve is positioned behind that length of the inner facing wall and access to the sleeve is prevented by the wall except through openings 90, 92 and port 106.

Seals 94 are provided between the walls defining chamber 86 and sleeve 82 to resist leakage between bore 102*a* and outer surface 84*c* past the sleeve when it is closed and to resist fluid leakage between end 82*a* and end 82*b* to ensure that a pressure differential can be established therebetween. Since some fluid may be communicated to the sleeve through port 106 as well, as through port 90, seals 94 may be positioned to also ensure that a pressure differential can be established between port 106 and end 82*b*.

Releasable locking devices may be employed to releasably hold the sleeve in a closed position and/or an open position. For example, shear pins, snap rings, collets, etc. may be employed between the sleeve and the wall. In the illustrated embodiment, shear pins 96*a* are installed between the sleeve and wall 84 to hold the sleeve in the closed position. The shear pins may be selected such that the sleeve only moves after a sufficient pressure differential is achieved across the sleeve. A collet/gland 96*b/c* are employed to hold the sleeve in the open position.

In use, valve sub 80 may be connected into a liner string 102, such as of casing, liner, etc., and installed in a borehole to provide access via ports 106 from its inner bore 102*a* to the formation through which the borehole is drilled. Valve sub 80 can accommodate and be operated by a tool such as tool 118 that can set a seal on inner wall length D such that a pressure differential can be established between port 90 and 92. If there is no isolation between ports 90 and 92, forces are equalized across sleeve 82 and it will not move to open.

FIG. 7 shows tool 118 in an operative position in sub 80. Tool 118 is set to expand element 126 isolating the pressure communication path to one end 82*a* of the sleeve from the pressure communication path to opposite end 82*b*. Using tool 118, therefore, a pressure differential can be readily established across the sleeve from end 82*a* to end 82*b* thereof and the sleeve can be moved as a piston.

As noted above, length D of inner facing surface 84*d* spans between port 106 and opening 92. This length is sufficient to accept sealing engagement of element 126 thereagainst, between openings 90 and 92. Port 90, being uphole of element 126, is in communication with surface through the annulus, as shown, and, thus, pressures can be communicated thereto and to end 82*a*. A pressure differential may be established across sleeve 82 by increasing the pressure above element 126, which is communicated to end 82*a*, while the area below element 126, and therefore the pressure at end 82*b*, remains at ambient. When a sufficient pressure differential is reached to shear pins 96*a*, the sleeve moves down toward end 84*b* from a closed position to an open position (FIG. 7). When the dogs of collet 96*b* reach gland 96*c*, the dogs will lock into the gland to hold the sleeve up in an opened position.

The holding strength of shear pins can be selected. As such, sleeve 82 can be held from opening until the liner is that the liner may be brought to considerable pressures before shear pins 96*a* shear. Thus, shear pins can be selected such that a pressure hammer can be developed on the formation when sleeve 82 finally opens.

Valve 80 is also useful with a through-tubing tool 18 (FIG. 4), the only operational difference is that fluids are supplied through the tubing string 16, rather than through the annular area 115. The tool and the valve are selected such that the ports in the tool open before the ports in the valve.

When sleeve 82 is opened, fluids (arrows F2) can be pumped through ports 106 to treat the formation accessed at wellbore wall 104*a*.

If sub 80 is employed with a tool employing locator profile 112, the positions of locator profile 112, port 106 and openings 90, 92 can be considered when spacing seal 126 from keys 134, so that sealing element 126 is properly positioned between openings 90, 92, when key 134 is set against locator profile 112. Because of the close proximity of keys 134 and sealing element, valve sub 80 can be relatively compact with locator profile 112, port 106 and openings 90, 92 all on one tubular body. Thus, if desired, pup joints need not be employed in the liner, making the liner more flexible.

Valve sub 80 requires venting through opening 92 into a lower portion of the liner. Thus, the string below the valve must provide for or be opened to provide for displacement of the vented fluid from port 92 into the string below. In some assemblies, there may be a concern that there is insufficient capacity to vent fluid from chamber 86*a* into the liner. This may occur if port 106 of interest is the lowest one in the liner. In such a case, an outwardly venting valve may be provided, where the lower opening vents to outer surface 84*b* rather than to inner bore 102*a*. Such a valve is shown in FIG. 4, wherein port 6 is closed by a sliding sleeve 182 that is opened by creating a pressure differential between its ends, one end of which is exposed to liner pressure and the other end of which is exposed to annular pressure between liner 2 and wellbore wall 4*a*. An opening 190 provides fluid communication between one end of sleeve 182 and liner inner bore 2*a* and another opening 192 provides fluid communication between the opposite end of sleeve 182 exposed in chamber 186*a* and liner outer surface 2*c*.

A liner including a plurality of ports may employ a plurality of valve subs that have communication ports open to the inner wall of the liner, such as for example those described in reference to valve sub 80 of FIG. 7, since such a valve sub is only openable when a tool is set to isolate upper opening 90 from lower opening 92. Without a seal set between the openings 90, 92 of any particular sub 80, the sleeve cannot open. If a liner has a closed lower end, however, an outwardly venting valve, such as that described in respect of FIG. 4, may be employed as the lower-most valve in the liner.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A wellbore treatment tool for setting against a constraining wall in which the wellbore treatment tool is positionable, the wellbore treatment tool comprising:

a tool body including a first end formed for connection to a tubular string and an opposite end;

a no-go key assembly including a tubular housing and a no-go key, the tubular housing defining an inner bore extending along the length of the tubular housing and an outer facing surface carrying the no-go key, the no-go key configured for locking the no-go key and tubular housing in a fixed position relative to the constraining wall, the tubular housing sleeved over the tool body with the tool body installed in the inner bore of the tubular housing;

a sealing element encircling the tool body and positioned between a first compression ring on the tool body and a second compression ring on the tubular housing, the sealing element being expandable to form an annular seal about the tool body by compression between the first compression ring and the second compression ring; and a releasable lock to hold the sealing element against expansion.

2. The wellbore treatment tool of claim 1 wherein the sealing element is configured to be settable by pushing the tool body through the no-go assembly to apply a compressive force to the sealing element.

3. The wellbore treatment tool of claim 1 wherein the no-go key includes a downwardly facing shoulder for resisting movement of the no-go assembly downwardly along the constraining wall and the no-go key includes an upwardly facing chamfered end to facilitate movement of the no-go assembly upwardly along the constraining wall.

4. The wellbore treatment tool of claim 1 further comprising a retainer to hold the no-go key in a retracted position and a release mechanism for releasing the retainer.

5. The wellbore treatment tool of claim 4 wherein the release mechanism operates by hydraulic actuation.

6. The wellbore treatment tool of claim 4 wherein the release mechanism includes a valve to permit diversion of hydraulic pressure to actuate a release of the retainer and wherein the valve is removable after actuation of the release mechanism.

7. The wellbore treatment tool of claim 1 wherein the lock locks the tubular housing onto the tool body and is releasable to free the tubular housing for sliding movement along the tool body.

8. The wellbore treatment tool of claim 1 further comprising a retainer to hold the no-go key in a retracted position, a lock to hold the sealing element against expansion and a release mechanism for both releasing the retainer and unlocking the lock.

9. The wellbore treatment tool of claim 1 wherein the tool body includes an outer surface and further comprising a bore extending through the tool body from the first end toward the opposite end and a port opening from the bore onto the outer surface of the tool body in a position between the sealing element and the first end.

10. The wellbore treatment tool of claim 9 wherein the port is opened by pulling the tool body into tension.

11. The wellbore treatment tool of claim 9 wherein the port is opened by a pressure differential between the outer surface of the tool body and the inner bore.

12. A method for treating a formation accessed through a liner port in a wellbore, the method comprising:

running into the wellbore with a wellbore treatment tool connected to a tubing string, the wellbore treatment tool including a tool body including a first end formed for connection to a tubular string and an opposite end; a no-go key assembly including a tubular housing and a no-go key, the tubular housing defining an inner bore extending along the length of the tubular housing and an outer facing surface carrying the no-go key, the no-go key configured for locking the no-go key and tubular housing in a fixed position relative to the constraining wall, the tubular housing sleeved over the tool body with the tool body installed in the inner bore of the tubular housing; and a sealing element encircling the tool body and positioned between a first compression ring on the tool body and a second compression ring on the tubular housing, the sealing element being expandable to form an annular seal about the tool body by compression between the first compression ring and the second compression ring;

positioning the wellbore treatment tool with the sealing element positioned downhole of the liner port;

compressing the wellbore treatment tool to expand the sealing element to set the annular seal downhole of the liner port; and pumping a wellbore treatment fluid into the wellbore uphole of the annular seal and through the liner port into the formation.

13. The method of claim 12 wherein positioning includes activating the wellbore treatment tool to reconfigure the no-go key from an inactive to an active position, moving the no-go key uphole of a stop wall in the wellbore and moving the no-go key downwardly against the stop wall.

14. The method of claim 12 wherein positioning includes expanding the no-go key into a locator profile spaced from the liner port and compressing includes landing a shoulder of the no-go key against a stop wall in the locator profile and pushing the wellbore treatment tool down to drive the shoulder against the stop wall.

15. The method of claim 13 wherein pushing includes releasing weight into the tubing string.

16. The method of claim 12 wherein positioning includes running the wellbore treatment tool into the wellbore until the wellbore treatment tool lands in a marker profile and pulling the wellbore treatment tool a known distance from the marker profile to the liner port.

17. The method of claim 12 wherein pumping includes conveying wellbore treatment fluid through the tubing string and through a port on the tool body.

18. The method of claim 12 wherein pumping includes conveying wellbore treatment fluid through an annular space along an outer surface of the tubing string, while the tubing string inner bore is sealed against communication with the wellbore treatment fluid.

19. The method of claim 12 wherein after pumping the method further comprises equalizing pressure uphole and downhole of the annular seal.

20. The method of claim 12 wherein after pumping the method further comprises flushing fluid through the wellbore treatment tool into the wellbore downhole of the annular seal.

21. The method of claim 19 wherein pumping includes opening a sleeve valve over the liner port by creating a pressure differential uphole of the annular seal and downhole of the annular seal.

22. A wellbore treatment assembly comprising:

a liner installable in a wellbore, the liner including an inner bore defined within an inner wall, an outer surface, a first port extending from the inner wall to the outer surface, a first stop wall on the inner wall spaced axially from the first port, a second port extending from the inner wall to the outer surface spaced axially from the first port and a second stop wall on the inner wall spaced axially from the second port;

a tubular string extendible through the liner and manipulatable from surface; and a wellbore treatment tool for setting against the inner wall of the liner including:

a tool body including a first end formed for connection to the tubular string and an opposite end;

a no-go key assembly including a tubular housing and a no-go key carried on the tubular housing, the tubular housing defining an inner bore extending from a first end to a second end of the tubular housing and an outer facing surface carrying the no-go key and the tubular housing sleeved over the tool body with the tool body installed in the inner bore of tubular housing; and the no-go key biased out to engage against the stop wall and to prevent the no-go key and tubular housing from moving downwardly past the stop wall; and a sealing element encircling the tool body and positioned between a first compression ring on the tool body and a second compression ring on the tubular housing, the sealing element being expandable to form an annular seal about the tool body by setting the no-go key against the stop wall and pushing the tool body down to compress the sealing element between the first compression ring and the second compression ring.

23. The wellbore treatment assembly of claim 22 wherein the liner further comprises a sleeve moveable between a closed port position, wherein the sleeve closes the first port, and an open port position, wherein the sleeve is refracted from the first port; a first pressure communication path to a first end of the sleeve and a second pressure communication path to a second end of the sleeve, the first pressure communication path being axially spaced from the second pressure communication path such that a pressure differential can be established between the first end and the second end to move the sleeve.

24. The wellbore treatment assembly of claim 22 wherein the tool body includes an outer surface and an inner bore and the wellbore treatment tool further comprises a bypass valve on the tool body between the first end and the sealing element, the bypass valve openable by pulling the tool body into tension and when opened permitting flow of fluid from the outer surface to the inner bore.

25. The wellbore treatment assembly of claim 22 wherein the wellbore treatment tool further comprises a retainer to hold the no-go key in a retracted position, a lock to hold the sealing element against expansion and a release mechanism for both releasing the retainer and unlocking the lock.

26. The wellbore treatment assembly of claim 25 wherein the release mechanism is hydraulically actuatable by pressuring up through the string.

27. The wellbore treatment assembly of claim 25 wherein the release mechanism includes a valve to permit diversion of hydraulic pressure to actuate a release of the retainer and wherein the valve is removable after release of the retainer to unlock the lock.

28. The wellbore treatment assembly of claim 25 wherein the lock locks the tubular housing onto the tool body and is releasable to free the tubular housing for sliding movement along the tool body.

29. The wellbore treatment assembly of claim 25 wherein the tool body includes an outer surface and further comprising a bore extending through the tool body from the first end toward the opposite end and a port opening from the bore onto the outer surface of the tool body in a position between the sealing element and the first end.

30. The wellbore treatment assembly of claim 29 wherein the port is opened by pulling the tool body into tension.

31. The wellbore treatment assembly of claim 29 wherein the port is opened by a pressure differential between the outer surface of the tool body and the inner bore.

32. The wellbore treatment assembly of claim 22 wherein the wellbore treatment tool further comprises a marker key biased outwardly from the tool body and wherein the liner further comprises a marker profile downhole of the first port and the second port, the marker key formed with a shape to catch in only the marker profile in the liner and the marker profile being a known distance from the first port and the second port.

33. A wellbore treatment tool for setting against a constraining wall in which the wellbore treatment tool is positionable, the wellbore treatment tool comprising:

a tool body including a first end formed for connection to a tubular string and an opposite end;

a no-go key assembly including a tubular housing and a no-go key, the tubular housing defining an inner bore extending along the length of the tubular housing and an outer facing surface carrying the no-go key, the no-go key configured for locking the no-go key and tubular housing in a fixed position relative to the constraining wall, the tubular housing sleeved over the tool body with the tool body installed in the inner bore of the tubular housing;

a sealing element encircling the tool body and positioned between a first compression ring on the tool body and a second compression ring on the tubular housing, the sealing element being expandable to form an annular seal about the tool body by compression between the first compression ring and the second compression ring; and a retainer to hold the no-go key in a refracted position and a release mechanism for releasing the retainer.

34. The wellbore treatment tool of claim 33 wherein the release mechanism operates by hydraulic actuation.

35. The wellbore treatment tool of claim 33 wherein the release mechanism includes a valve to permit diversion of hydraulic pressure to actuate a release of the retainer and wherein the valve is removable after actuation of the release mechanism.

36. The wellbore treatment tool of claim 33 further comprising a lock to hold the sealing element against expansion and the release mechanism further is configured for unlocking the lock.

37. A wellbore treatment tool for setting against a constraining wall in which the wellbore treatment tool is positionable, the wellbore treatment tool comprising:

a tool body including an outer surface, a first end formed for connection to a tubular string, an opposite end, and a bore extending through the tool body from the first end toward the opposite end;

a no-go key assembly including a tubular housing and a no-go key, the tubular housing defining an inner bore extending along the length of the tubular housing and an outer facing surface carrying the no-go key, the no-go key configured for locking the no-go key and tubular housing in a fixed position relative to the constraining wall, the tubular housing sleeved over the tool body with the tool body installed in the inner bore of the tubular housing;

a sealing element encircling the tool body and positioned between a first compression ring on the tool body and a second compression ring on the tubular housing, the sealing element being expandable to form an annular seal about the tool body by compression between the first compression ring and the second compression ring; and a port opening from the bore onto the outer surface of the tool body in a position between the sealing element and the first end.

38. The wellbore treatment tool of claim 37 wherein the port is opened by pulling the tool body into tension.

39. The wellbore treatment tool of claim 37 wherein the port is opened by a pressure differential between the outer surface of the tool body and the bore.

* * * * *